US005678979A

United States Patent [19]

Kovacs

[11] Patent Number: 5,678,979

[45] Date of Patent: Oct. 21, 1997

[54] TILT LINKAGE SYSTEM FOR LOAD ELEVATING VEHICLES

[76] Inventor: Geza Kovacs, 1102 Sugartree Dr. South, Lakeland, Fla. 33813

[21] Appl. No.: 510,091

[22] Filed: Aug. 1, 1995

[51] Int. Cl.[6] ..... E02F 3/42

[52] U.S. Cl. ..... 414/700; 414/710; 414/917

[58] Field of Search ..... 414/700, 710, 414/711, 712, 713, 917, 706, 707

[56] References Cited

U.S. PATENT DOCUMENTS

| | | | |
|---|---|---|---|
| 2,628,730 | 2/1953 | Speicher et al. | 414/711 |
| 2,712,389 | 7/1955 | Sewell et al. | 414/707 |
| 2,773,613 | 12/1956 | Burrus | 414/713 |
| 3,888,371 | 6/1975 | Moreau . | |
| 4,699,560 | 10/1987 | Ostermayer et al. | 414/917 |
| 5,192,179 | 3/1993 | Kovacs | 414/711 |
| 5,533,856 | 7/1996 | Friesen et al. | 414/917 |

FOREIGN PATENT DOCUMENTS

| | | |
|---|---|---|
| 401738 | 3/1970 | Australia . |
| 247643 | 7/1987 | Germany . |

*Primary Examiner*—Karen B. Merritt
*Assistant Examiner*—Gregory A. Morse
*Attorney, Agent, or Firm*—Dowell & Dowell

[57] ABSTRACT

A tilt linkage mechanism for controlling the pitch of an implement used with load elevating vehicles which includes an actuation cylinder which is mounted intermediate to the length of the implement lift arms and which is utilized to control the rotation of at least one pivot shaft connected to the vehicle lift arms so as to be in parallel relationship between a first pivot axis where the lift arms are connected to the vehicle and a second pivot axis where the lift arms are pivotally connected relative to the implement. At least one parallel linkage assembly is connected to the at least one pivot shaft and to pivot points spaced on either side of the second pivot axis and stabilizer elements are provided for allowing rotation of the actuation cylinder during use for adjusting the pitch of the implement.

15 Claims, 9 Drawing Sheets

FIG. 5
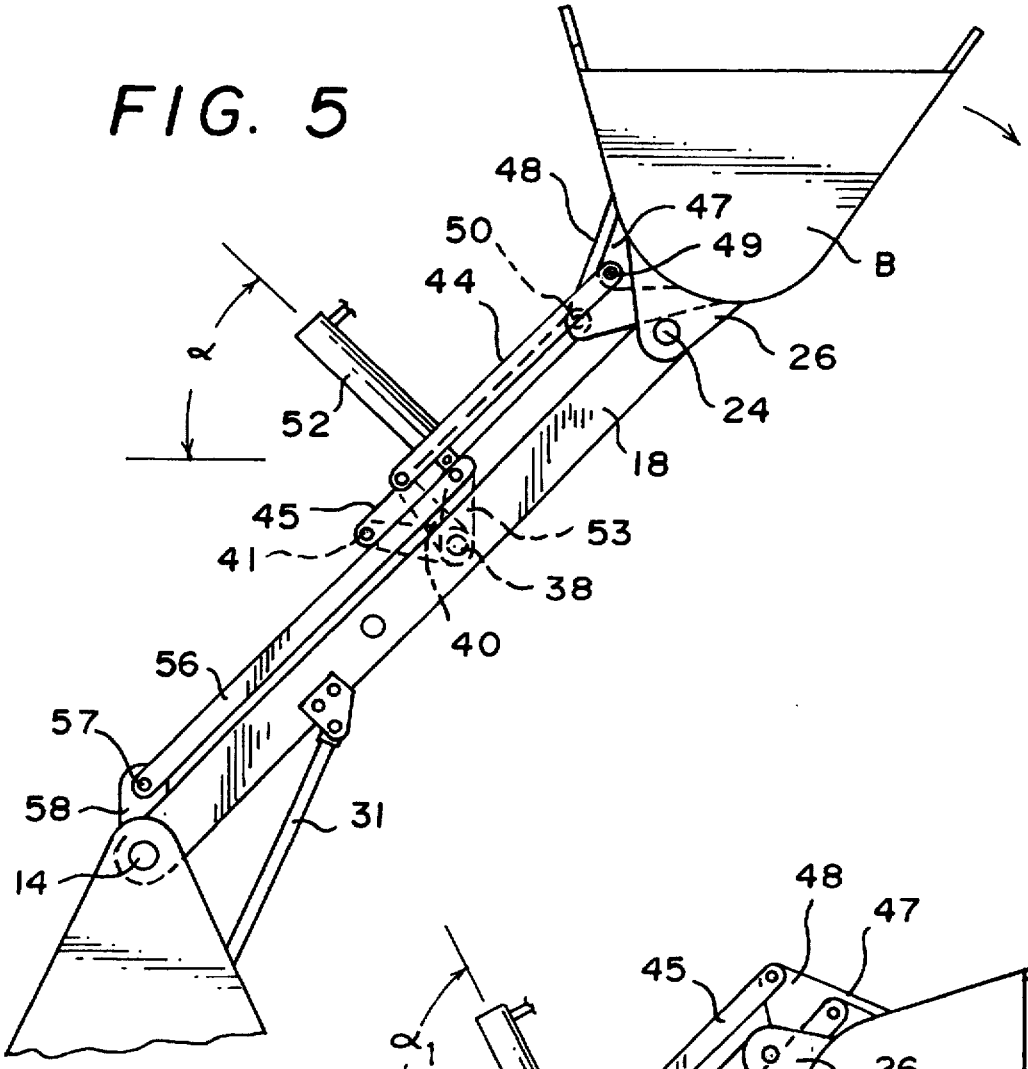
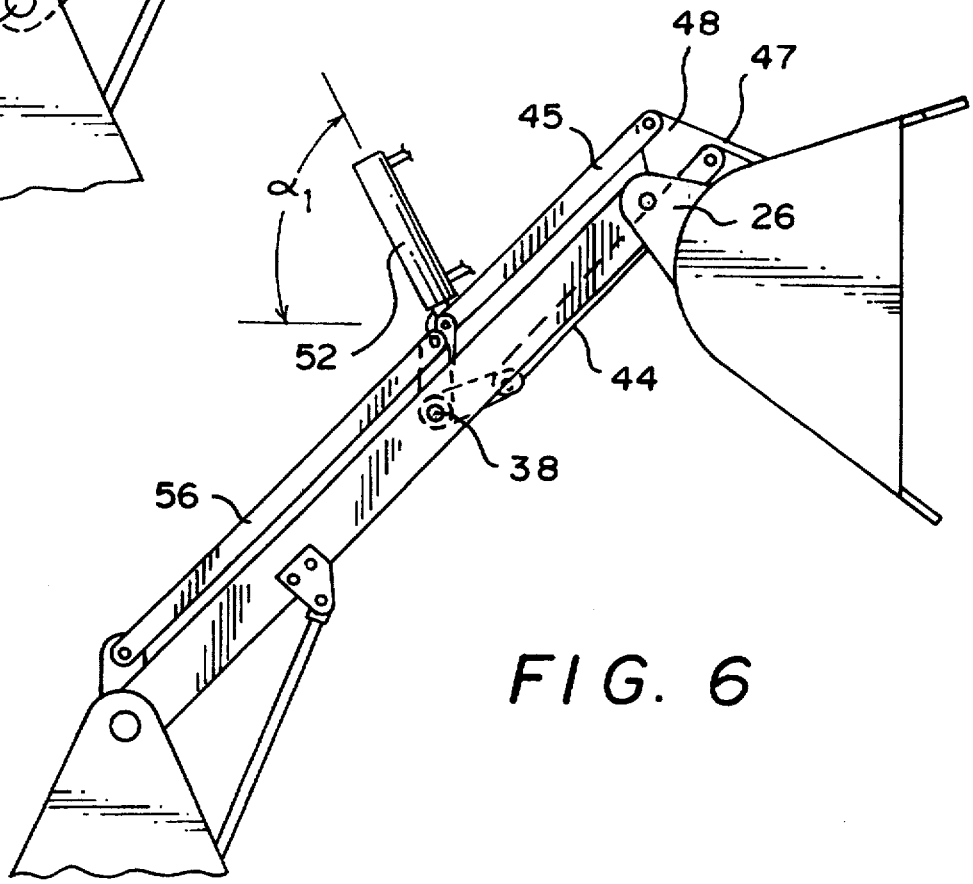
FIG. 6

52
54
42
44
56
43
41
40
45
53
62
61
63
38
36
37
18

52
54
56
43
55
53
60
36
37
41
61
18
62
63
38

104
345
344
49
47
50
48
124
341
348
340
245
103
122
241
113
112
110
123
105
B
245
240
121
238
145
111
144
141
140
163
382
160
152
154
153
138
156
102
100'
108
100
157
158
383
380
384
145
144
141
140
163
382
160
152
154
153
138
102

TILT LINKAGE SYSTEM FOR LOAD ELEVATING VEHICLES

BACKGROUND OF THE INVENTION

1. Field of the Invention

This invention is generally directed to the lift arm(s) and tilt linkage mechanisms by way of which implements are raised, lowered and angularly adjusted relative to load lifting vehicles such as front-end loaders, backhoes, skid-steered tractors, bulldozers, forklifts and the like and more specifically to a multiple parallelogram tilt linkage system which, in cooperation with the lift arm or arms of the vehicle, automatically ensures that the pitch of the implement is not altered as the lift arms raise and lower the implement unless the controls for adjusting the pitch of the implement are activated. The invention is also directed to tilt linkage systems for load elevating vehicles wherein one or more tilt cylinders for adjusting the pitch of the implement relative to the vehicle are mounted intermediate the vehicle body and the implement.

2. History of the Related Art

One of the primary problems associated with construction and load lifting and construction vehicles is that the implements associated therewith are continuously subject to change in pitch relative to the vehicles as the implements are raised and lowered by the lift arm(s) of the vehicles. Due to the change in the pitch of an implement the loads supported thereby are not maintained level as they are raised and lowered. In those instances where the implement is a bucket having aggregate material loaded therein, if the bucket changes from a level position, the material may be accidentally discharged from the bucket. Similar problems occur when transporting pallets on which materials are stacked or when transporting and aligning loads of sensitive materials such as in the lifting of munitions from ammunition carrying carts to aircraft in which the munitions are to be loaded.

In view of the foregoing problem there have been numerous attempts to provide lift arm and tilt linkage mechanisms which will compensate for the change in pitch of an implement as the implement is raised or lowered. Unfortunately, such conventional systems do not provide a true self levelling system which will ensure a continuous fixed pitch alignment between the implement and the vehicle regardless of the degree of elevation of the implement with respect to the vehicle as the implement is raised or lowered by the vehicles lift arm assembly.

In U.S. Pat. No. 5,192,179, the applicant of the present invention discloses a unique double parallel linkage mechanism for controlling the tilt linkage by way of which an implement is levelled with respect to the lift arms of a vehicle. The patent discloses a tilt cylinder which is mounted to the body of the vehicle and which controls a lever connected to a knuckle assembly which rotates about a pivot axis which extends parallel to the pivot axis of the vehicle lift arms. A first pair of linkage elements are connected in fixed relationship with respect to the knuckle and have outer ends to which are pivotally secured a pair of parallel elongated linkage members which extend toward the implement supported by the lift arms. In the basic embodiment disclosed, the outer ends of the elongated linkage members are pivotally secured to a pair of spaced brackets so that the outer ends thereof maintained a pivotal relationship equal to that of the pivotal relationship of the inner ends to the first pair of linkage members. In this manner, a pair of parallel linkages are established utilizing the vehicle lift arms as portions of the linkage assemblies which functioned to stabilize and automatically adjust the pitch of the vehicle element regardless of the elevated position of the lift arms. In this manner, the pitch of the implement is positively maintained regardless of the positioning of the implement lift arms, thereby stabilizing any load supported by the implement. In a separate embodiment, additional sets of parallel linkages could be positioned intermediate the first set of linkage assemblies and the implement and still maintain the positive control over the pitch of the implement during raising and lowering of the vehicle lift arms.

Unfortunately, due to the manner in which the bodies of many load elevating vehicles are constructed, it is not always possible to mount the vehicle tilt cylinder directly to the body of the vehicle without having to modify the vehicle structure. This means that some existing load elevating equipment can not be easily retrofitted with the linkage assemblies disclosed in applicant's prior patent.

In view of the foregoing, a need has arisen to develop a mechanical linkage system which provides for the unique continuous stabilization and pitch control disclosed by applicant's prior patent and which can be used to retrofit existing lift equipment.

SUMMARY OF THE INVENTION

This invention is directed to lift arm and tilt linkage systems for use with load carrying vehicles including front-end loaders, bulldozers, backhoes, forklifts, tractors and the like wherein the vehicles include implements such as buckets, scoops, forks, or other load elevating devices wherein the implements are automatically and continuously maintained in a fixed pitch or level position with respect to the vehicle as the implements are raised and lowered by the vehicle lift arm or arms. With the invention the lift arm or arms are connected to a vehicle so as to be moveable about a first pivot axis and are connected to the implement so as to be moveable about a second pivot axis which axes are parallel with respect to one another. A tilt cylinder, or cylinders, for controlling the pitch of the implement is mounted about a third pivot axis parallel to the first and second pivot axes and which is stabilized by linkages pivotally connected to the vehicle about an axis parallel to the first pivot axis.

The tilt linkage assembly includes at least one pivot shaft which is mounted to brackets which are fixed to the vehicle lift arm or arms so that the shaft or shafts extend generally perpendicularly with respect to the lift arm or arms and parallel to the first and second pivot axes defined by the lift arms and is spaced intermediate the length of the lift arms between the first and second pivot axes. In a first embodiment, a pair of arms are fixedly mounted to the pivot shaft in spaced relationship with respect to one another and in angular off-set relationship to one another. A pair of elongated links have first ends which are pivotally mounted to the outer ends of the arms and second ends which are pivotally mounted to the implement or to an implement support bracket or frame. A first of the links is mounted on one side of the second pivot axis but parallel thereto, and the second link is mounted on the other side of but parallel to the second pivot axis. In this manner, a pair of imaginary parallelograms, or a double parallelogram linkage, are created each having a common side which is defined by the vehicle implement arm or arms. Each parallelogram has elongated sides defined by one of the links and an implement arm and shorter sides defined by one of the arms connected to the pivot shaft and an imaginary line between the point of mounting of the outer end of the links with the implement or implement frame and the second pivot axis.

To adjust the pitch of the implement, a tilt cylinder(s) is mounted in fixedly spaced but pivotal relationship with respect to the pivot shaft by a pair of stabilizing arms which are pivotally mounted in parallel relationship and extend outwardly from the pivot shaft. The stabilizing arms are pivotally connected by aligned pivot pins to the outer end of a first single parallel linkage which includes at least one stabilizing never which extends from an inner end which is pivotally connected to one or more brackets mounted to the vehicle body about an axis which is parallel to the first pivot axis defined by the lift arms. One end of the tilt cylinder is pivotally mounted to the stabilizing arms. The cylinder includes a piston rod having an outer end which is pivotally mounted to a control lever which is fixedly mounted at its opposite end to the pivot shaft.

In order to change the tilt of the implement, the piston rod is activated to pivot the control lever to thereby rotate the pivot shaft which simultaneously pivots the arms of the double parallel linkage assembly.

With the tilt linkage system of the present invention, if the tilt cylinder is not activated as the lift arms are raised and lowered, each of the parallel tilt linkage mechanisms automatically shifts or re-aligns relative to the first and second pivot axis to thereby continuously maintain the pitch or tilt of the implement in a fixed orientation regardless of the elevation of the implement with respect to the vehicle. In some embodiments, lift arms having a plurality of segments and a plurality of double parallelogram tilt linkages may be connected in end-to-end relationship between the pivot axis and the implement, or the implement mounting frame, so that different lift capabilities are provided for, such as in the case of a backhoe implement.

In order to adjust the angle of inclination of the implement, the tilt cylinder is activated to shift the control lever. During this activation, the tilt cylinder pivots with respect to the stabilizing lever(s) and arms so that, in use, the cylinder is pivotal from a generally parallel relationship with respect to the lift arms to an angular relationship with respect to the lift arms.

In some instances, it may be necessary to provide two cylinders for controlling the pitch or angle of an implement relative to the vehicle lift arms. In accordance with another embodiment of the present invention, the cylinders are each connected to separate stabilizing arms and levers similar to those previously discussed. In addition, each cylinder activates a control lever which rotates a separate pivot shaft with each of the pivot shafts being aligned with one another between the boom or lift arms. The double parallelogram linkage includes links as previously discussed having outer ends which are secured to pivot points connected to the implement or to an implement mounting frame and inner ends which are connected by way of a double crank to spaced arms having opposite ends connected to each of the spaced pivot shafts.

In yet another embodiment, special mounting brackets may be utilized to mount the stabilizing levers relative to the first pivot axis to thereby facilitate the retrofitting of the tilt linkage assembly of the present invention to a particular vehicle.

It is a primary object of the present invention to provide a continuously self-levelling tilt linkage system for use in mounting implements to load lifting and carrying vehicles which linkage system continuously maintains a predetermined pitch of the implement relative to the vehicle as the implement is raised or lowered with respect to the vehicle and with the pitch of the implement only being altered upon the direct activation of at least one cylinder mounted along the length of at least one implement lift arm.

It is also an object of the present invention to provide a linkage mechanism for regulating the tilt of an implement relative to a vehicle such as a front-end loader, bulldozer, skid-steered tractor, backhoe, forklift and the like wherein a mechanical multiple parallelogram assembly is defined by shiftable linkages and the lift arms of the vehicle and which provides a low cost yet durable mechanism for ensuring a continuous self-levelling of the implement during its vertical repositioning by the raising and lowering of the vehicle lift arms.

It is a further object of the present invention to provide a tilt linkage system and vehicle lift arm assembly for use with a load lifting vehicle wherein sets of linkages and lift arm members may be connected in end-to-end relationship to thereby allow greater flexibility in positioning of an implement relative to the vehicle and wherein the level or pitch of the implement is continuously maintained unless selective adjustment is made by activation of the controls for a tilt cylinder mounted intermediate the length of the lift arms.

It is also an object of the present invention to provide a tilt control system for a vehicle lift implement which is adapted for retrofitting existing load elevating vehicles, wherein the tilt control double parallelogram system is mounted in spaced relationship with respect to the vehicle body along the length of the vehicle lift arm or arms and is connected to the vehicle through a single parallelogram linkage so that the tilt cylinder(s) and linkage assemblies will not interfere with any portion of the vehicle body when in use.

BRIEF DESCRIPTION OF THE DRAWINGS

FIG. 5 is a partial side elevation view showing the lift arm and linkage control linkages of FIG. 1 with the bucket in the same pitch position as shown in FIGS. 3 and 4 with the lift arms being in a fully raised position.

FIG. 6 is a view similar to that in FIG. 5 wherein the tilt cylinder has been activated to change the pitch of the bucket from the pitch position shown in FIG. 5.

DESCRIPTION OF THE PREFERRED EMBODIMENT

Figure 1:
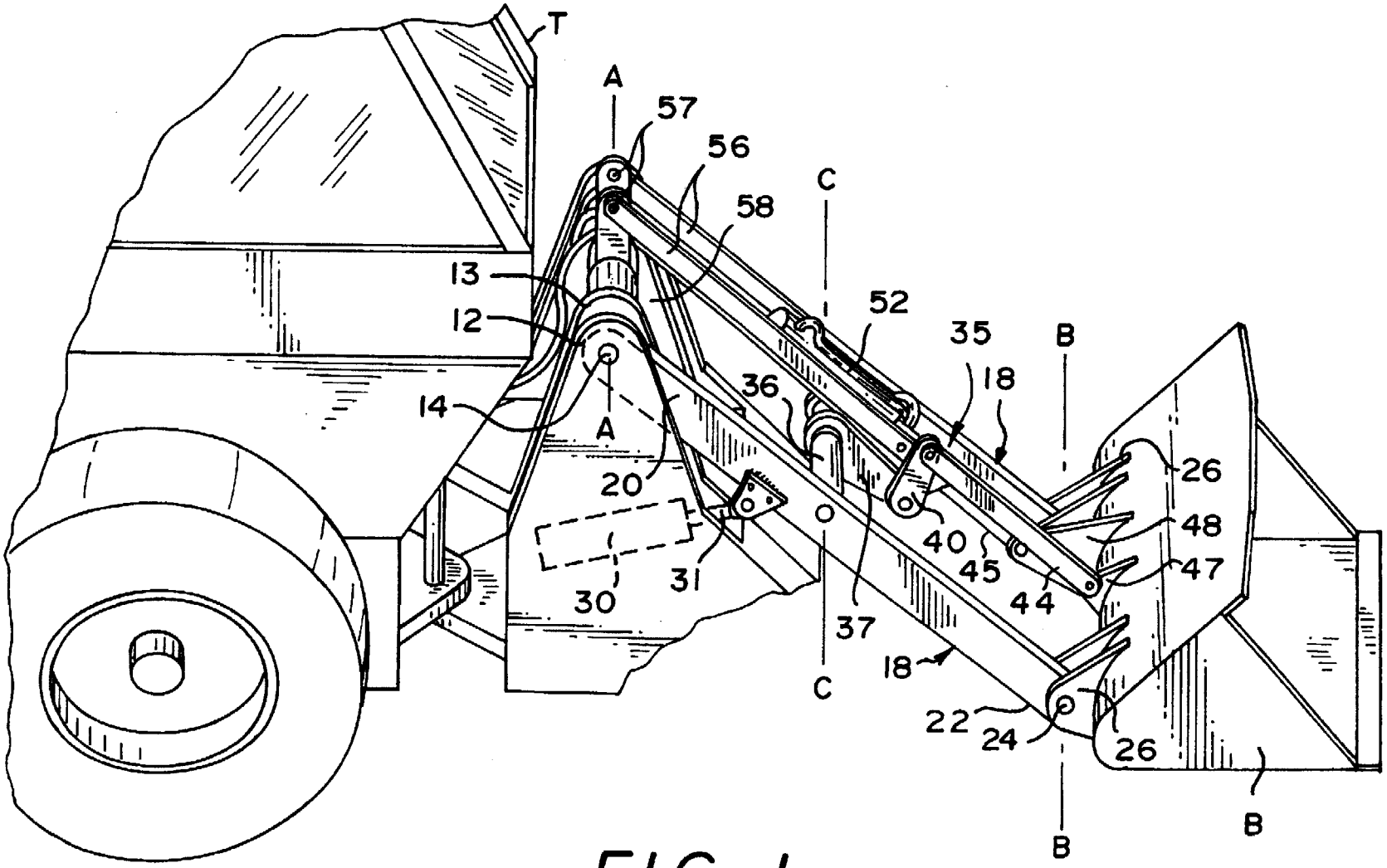
FIG. 1 is a partial side perspective view of a first embodiment of lift arm and tilt linkage system for load elevating vehicles of the present invention showing an implement bucket mounted to the front end of a vehicle such as a tractor.
Figure 2:
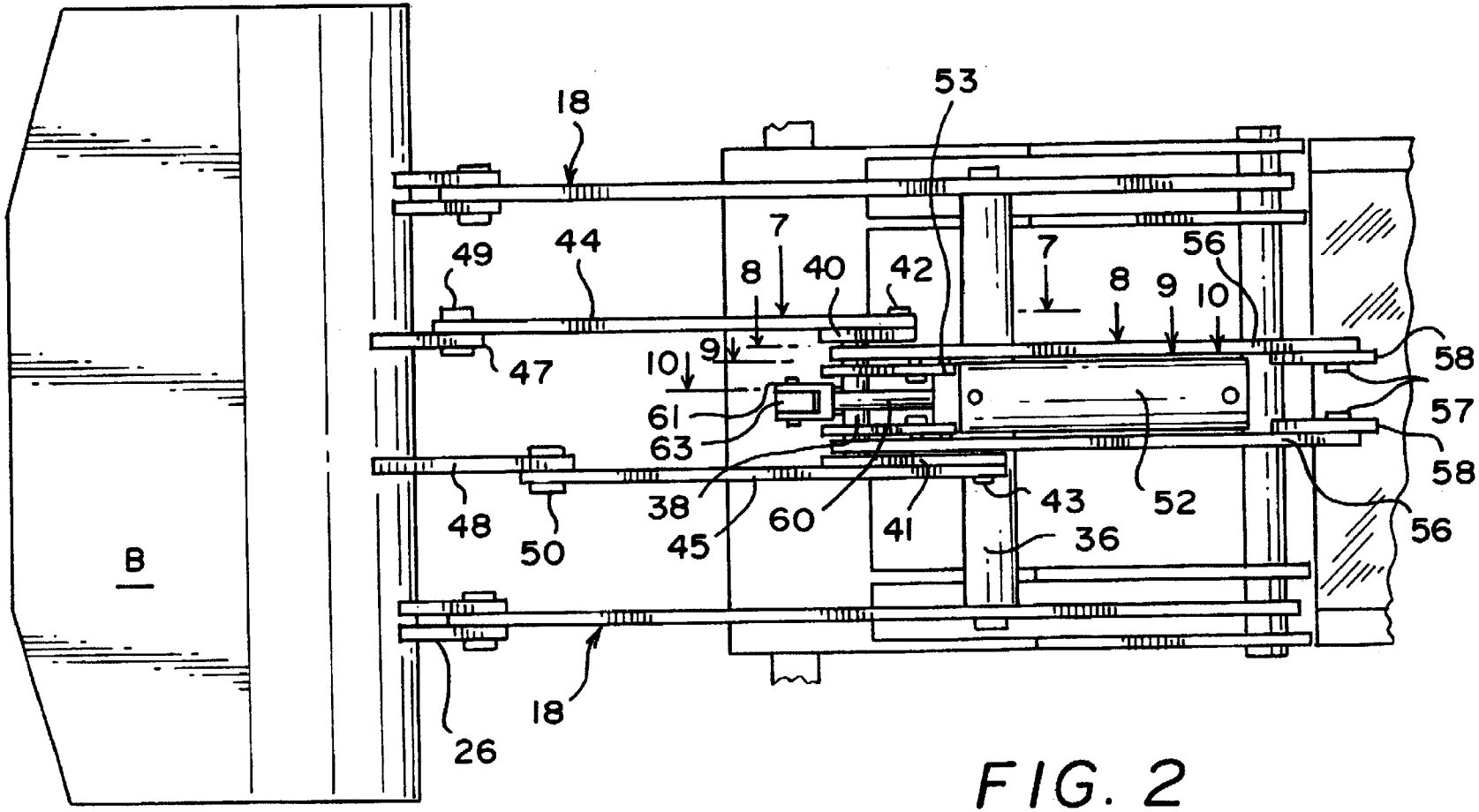
FIG. 2 is a top plan view of the lift arm and tilt linkage system of FIG. 1.

With reference to the drawings figures, the invention will be disclosed in greater detail. The linkage and lift arm assemblies are shown as being mounted to the front end of a loader or tractor "T". In the drawing figures the implement shown is a conventional earth working bucket WB having a generally convex rear surface and a front lower leading edge. Although the implement shown is a bucket, it should be emphasized that the invention may be utilized to mount any type of implement including forks, grab hooks, load lifting platforms and the like to the vehicle. In addition, in some instances, it may be desirable to utilize a mounting frame to which different implements may be attached and wherein the connections discussed with respect to the invention would be provided on the back of the implement mounting frame.

The tractor "T" includes a pair of spaced mounting brackets 12 and 13, or lift arm towers, having pivot pins 14 which are aligned along a first pivot axis A—A. To lift the bucket WB vertically with respect to the tractor, a pair of lift arms or boom members 18 have their inner ends 20 pivotally mounted to the pivot pins 14. The outer ends 22 of lift arms 18 are shown as being pivotally mounted by connecting bolts 24 to spaced pairs of flange elements 26 which extend from the rear of the bucket WB. The bolts 24 are aligned along a second pivot axis B—B. To raise the bucket lift arms 18, hydraulic cylinders 30 are mounted to the vehicle below each lift arm. Each cylinder has a piston rod 31 engaging the adjacent lift arm spaced from the inner ends thereof.

As the bucket is pivotally mounted to the outer ends of the lift arms, it is necessary to stabilize the pitch of the bucket relative to the lift arms as it is raised and lowered. A tilt linkage assembly 35 is provided for ensuring not only stabilization of the bucket during raising and lowering but also to control the pitch of the bucket relative to its pivot axis B—B. Further, the tilt linkage assembly will continuously assure that once a pitch has been established between the bucket and its pivot axis that such pitch will be maintained regardless of the elevation of the bucket relative to the tractor "T".

To make the tilt linkage assembly 35 of the present invention adaptable to retrofit existing load elevating vehicles, the linkage assembly is mounted intermediate the inner and outer ends of the implement lift arms. To accomplish this, a support rod 36 is mounted to the lift arms in spaced relationship with respect to the pivot axes A—A and B—B and perpendicularly to the lift arms. A pair of mounting brackets 37 are fixedly mounted to the support rod and extend forwardly thereof toward the implement. Aligned openings are provided in the brackets spaced from the support rod 36 in which is pivotally mounted a pivot shaft 38 which is utilized to control movement of the linkage system associated with the tilt linkage assembly, as will be discussed in greater detail hereinafter. The pivot shaft is located along an axis C—C which is parallel to axes A—A and B—B.

A pair of arms 40 and 41 have their lower ends fixedly mounted to the pivot shaft and are spaced from one another in an angular off-set relationship. The off-set angle may vary. Each of the arms 40, 41 includes an outer portion having pivot pins 42 and 43, respectively, extending therethrough which are equally spaced with respect to the pivot shaft 38. A pair of generally parallel links 44 and 45 have their first ends pivotally mounted to the pivot pins 42 and 43 respectively, and extend toward the implement WB.

Figure 3:
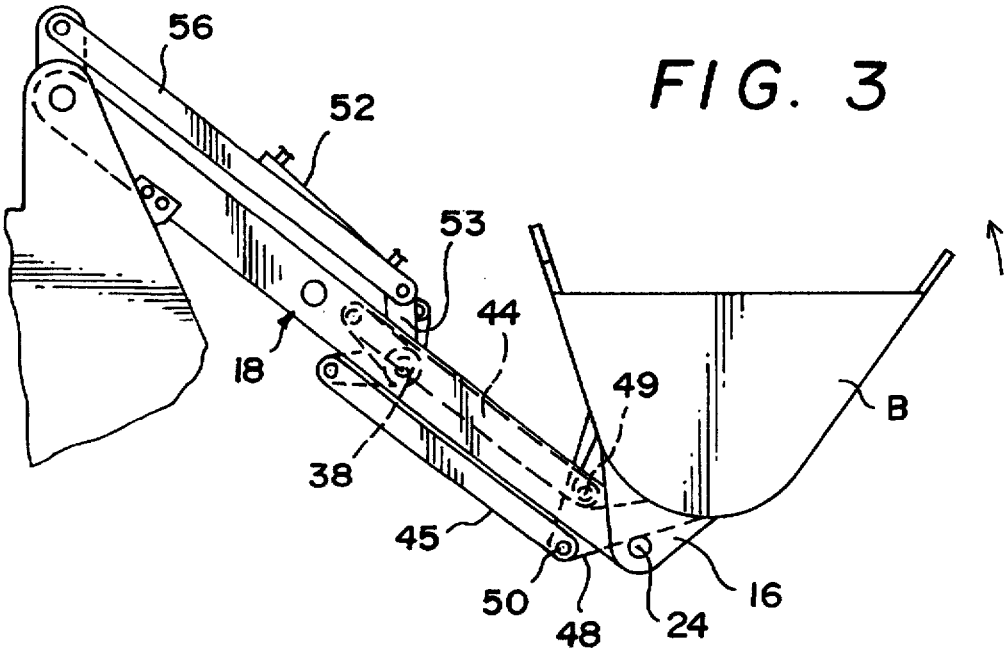
FIG. 3 is a partial side elevational view of the lift and tilt control linkage of FIG. 1 showing the implement in a first pitch position with the vehicle lift arms in a lower position.

Mounted to the rear of the implement are a pair of rearwardly extending plates 47 and 48 which are spaced from one another by the same distance and off-set angle that the arms 40 and 41 are spaced relative to one another. As shown, plate 47 extends outwardly relative to the back of the bucket at a lesser distance than plate 48. Pivot pins 49, 50 are mounted through the plates and serve to connect the outer or second ends of the links 44 and 45 in pivotal relationship to plates 47 and 48, respectively. As shown, pivot pin 49 is spaced between the pivot axis B—B and the implement whereas pivot pin 50 is spaced outwardly from the axis B—B. Further, and as specifically shown in FIG. 3, the spacing between the pivots 49 and 50 and the pivot axis B—B is identical to the spacing between the pivots 42 and 43 and the pivot axis C—C of the pivot shaft 38. This relationship between the pivot points associated with the bucket and the links 44 and 45 and pivot pins 42 and 43 of the arms 40 and 41, respectively, and the opposite end of the links ensure that the angular and spaced relationship of each of the relative pivot points remains constant whenever the lift arms are raised and lowered, as is shown in FIGS. 3 though 5, so the bucket is retained in a fixed pitch orientation or inclination.

Figures 14, 15:
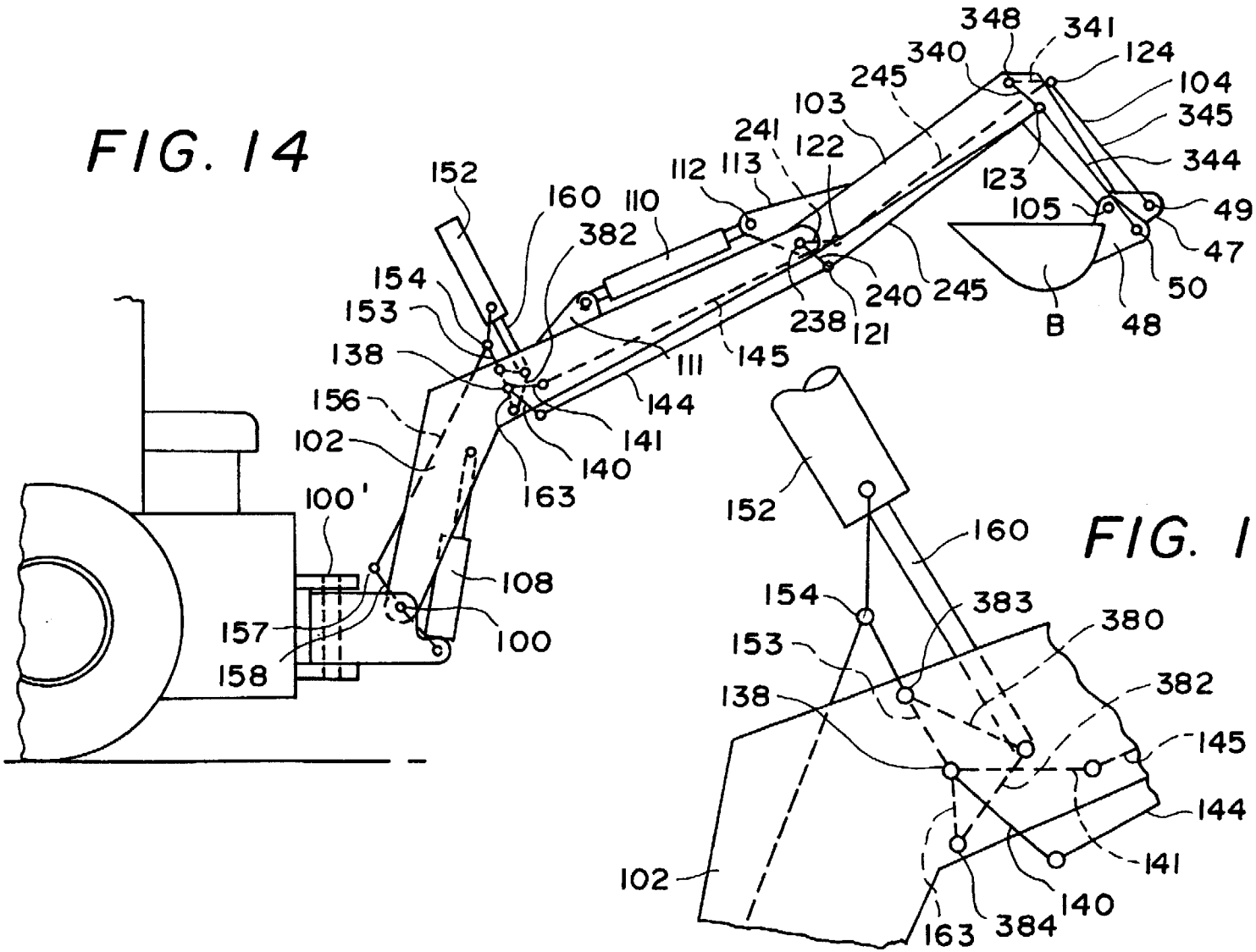
FIG. 14 is a partial side elevational view illustrating another embodiment of the present invention.
FIG. 15 is an enlarged partial view of the tilt linkage cylinder and related linkage shown in FIG. 14.

The tilt linkage assembly 35 together with the lift arms 18 define a double parallelogram support and tilt mechanism wherein each of the parallelograms shares a common side defined by a line extending from the axis C—C to the axis B—B along a lift arm 18 which is equal in length to the length of the links 44 and 45 between the pivots 43 and 50 and the pivots 42 and 49, respectively. The remaining portion of each parallelogram is defined by a line connected between the pivot points 49 and 50 and the pivot axis B—B, respectively, and the length of the arms 40 and 41 from the pivot shaft 38. It is contemplated that additional tilt linkage members could be used so that two, three or more double parallelograms could be defined between the pivot axis C—C and the pivot axis B—B, as is shown in FIG. 15.

To adjust the pitch of the implement B, a tilt cylinder 52 is mounted relative to pivot shaft 38 by a pair of stabilizing arms 53 which are spaced on each side of the cylinder and which are attached thereto by pivot pins 54. Each of the stabilizing arms 53 is pivotally mounted about the pivot shaft 38 and is further stabilized adjacent their upper end by pivotal connectors 55 to a pair of spaced elongated stabilizing levers 56. The outer or opposite ends of the levers 56 are mounted to pivot pins 57 which extends through one of more flanges 58 mounted to the body of the vehicle. The pivot pins 57 are mounted along an axis which is spaced from, but parallel to, pivot axis A—A and the levers 56 are uniformly spaced from one another along their length. As opposed to using a pair of levers 56, a single lever may be utilized having a U-shaped bracket at the end which may be secured to the stabilizing arms 53. The U-shaped bracket, however, must be of sufficient size to allow pivotal movement of the cylinder 52 therein as will be described in greater detail hereinafter.

A shown in the drawing figures, the tilt cylinder 52 includes a piston rod 60 having an outer bracket 61 which is pivotally connected at 62 to one end of a control lever 63. The opposite end of the control lever is fixedly mounted to the pivot shaft 38 and controls the pivotal movement of the control shaft under the operation of the piston rod 60. As previously discussed, the end of cylinder 52 adjacent the piston rod is pivotally connected, as shown at 54, to the stabilizing arms 53 so that the entire cylinder and piston rod assembly rotates during extension or retraction of the piston rod. As the tilt cylinder is operated to extend and retract the piston rod to thereby rotate the pivot shaft 38 to adjust the parallel linkage to change the pitch of the implement "WB", the stabilizing arms 53 will be uniformly pivoted with respect to the pivot shaft under the control of the stabilizing levers 56.

Figure 4:
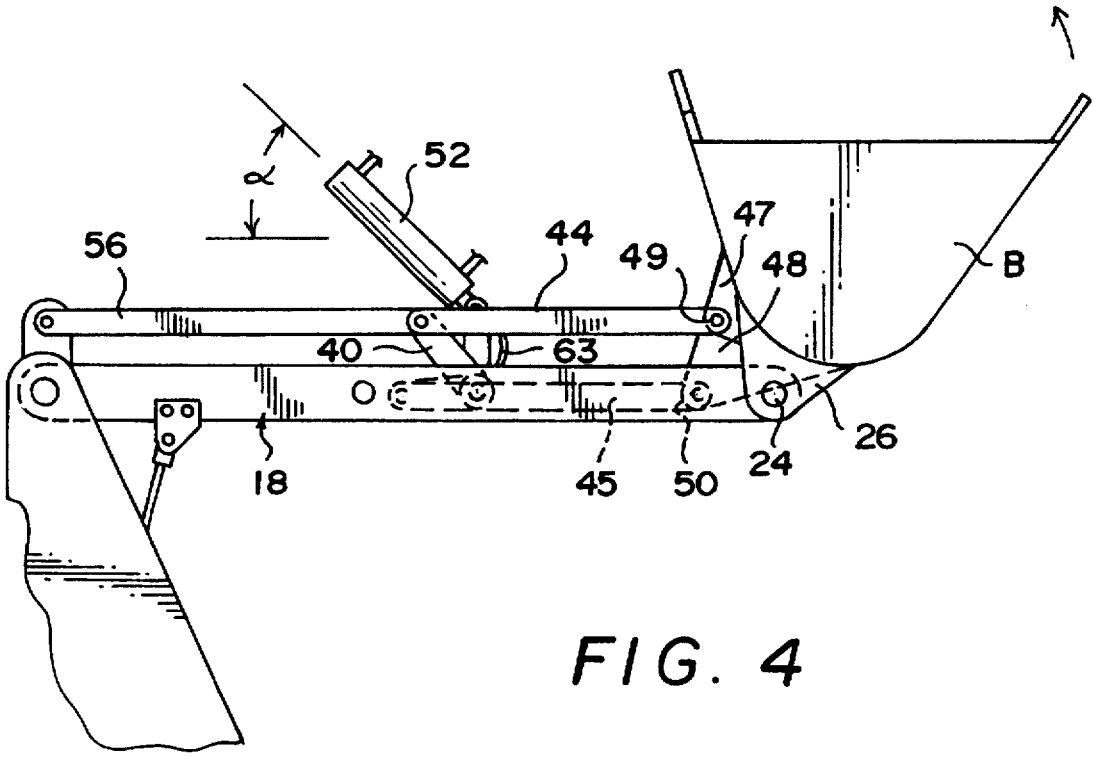
FIG. 4 is a partial side elevational view of the implement of FIG. 1 showing the vehicle implement in the same pitch as in FIG. 3 with the lift arms elevated to a substantially horizontal position.
Figure 7:
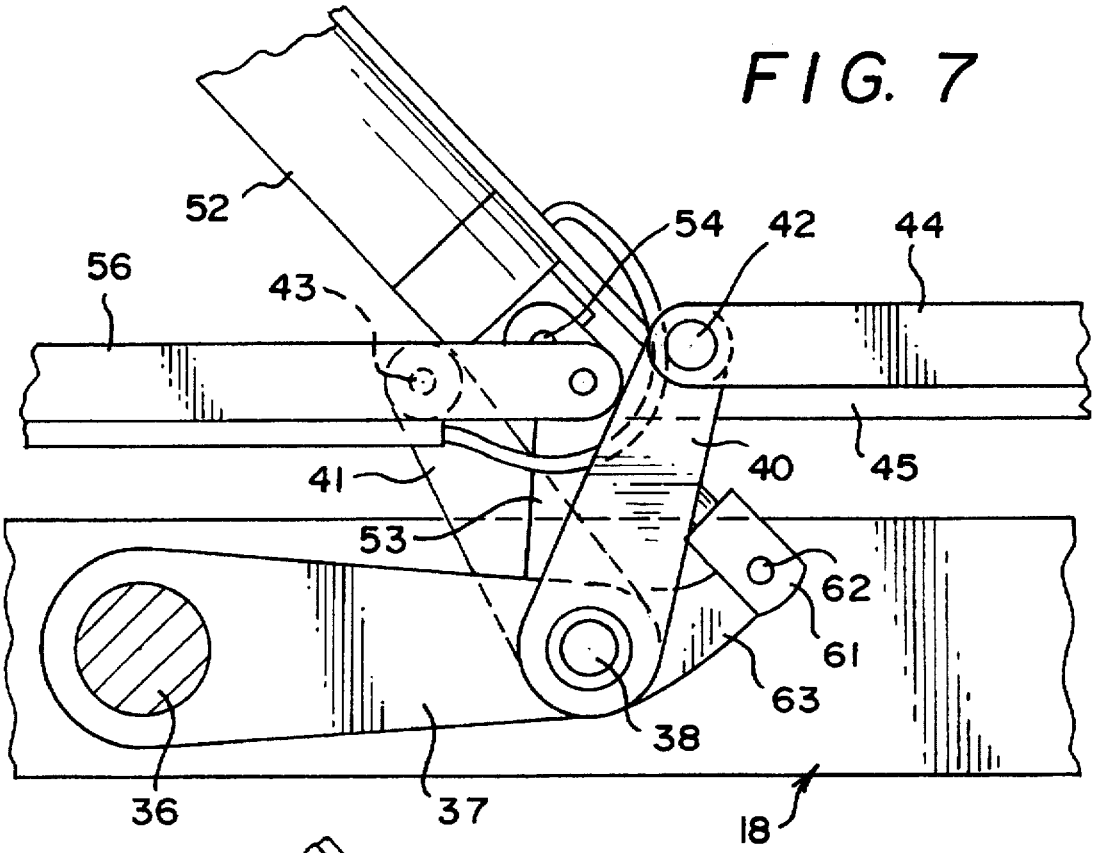
FIG. 7 is an enlarged cross-sectional view taken along line 7—7 of FIG. 2.
Figure 8:
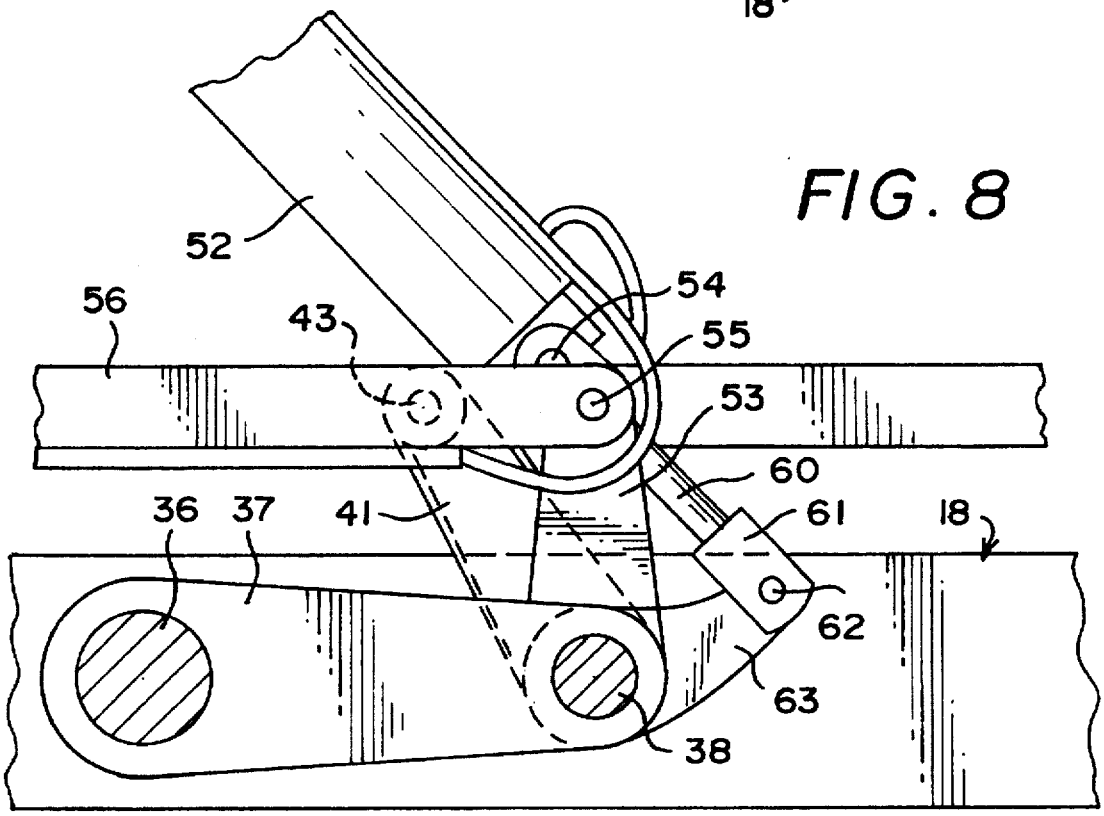
FIG. 8 is an enlarged cross-sectional view taken along line 8—8 of FIG. 2.
Figure 9:
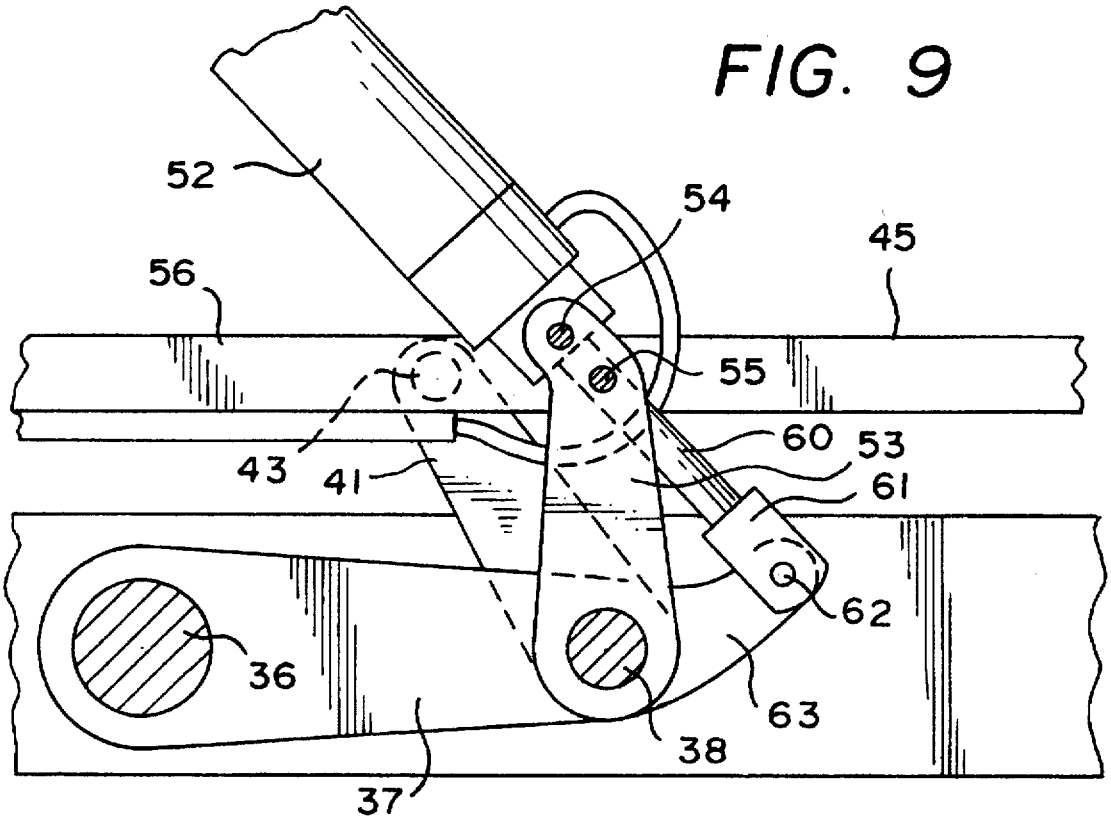
FIG. 9 is an enlarged cross-sectional view taken along line 9—9 of FIG. 2.
Figure 10:
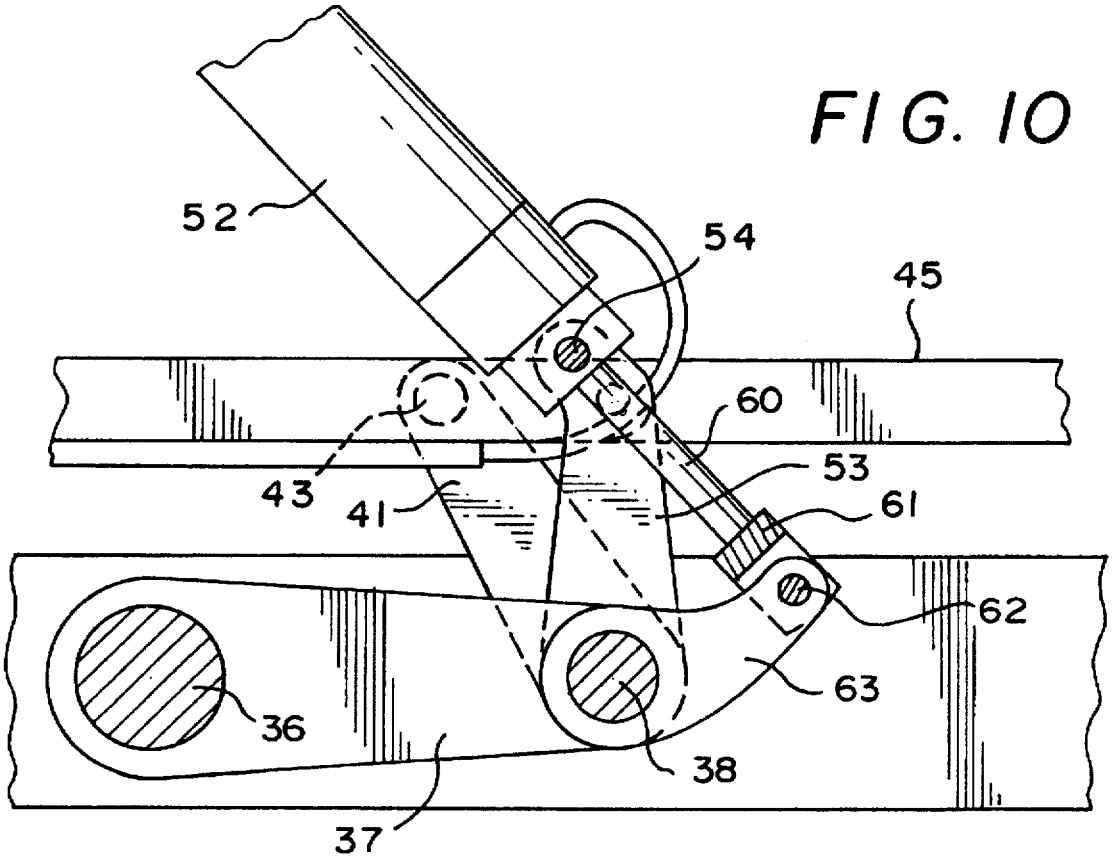
FIG. 10 is an enlarged cross-sectional view taken alone line 10—10 of FIG. 2.

As shown in FIGS. 3 through 5, the angle α of the tilt cylinder 52 relative to an imaginary horizontal line remains constant, unless activated, during the raising and lowering of the lift arms 18. As the angle of the tilt cylinder does not change, the pitch or position of the bucket WB also does not change and the double parallelogram linkage defined previously assures that no change in pitch angle occurs until the tilt cylinder is operated to either extend or retract the piston rod 60.

In FIGS. 3–5, three different elevated positions of the bucket are disclosed. The bucket, however, is retained in the identical pitch relationship with respect to the axis B—B about which the bucket is pivotally attached to the lift arms. During elevation of the lift arms, the pitch of the bucket is continuously maintained regardless of the elevation of the lift arms. The self levelling is accomplished by the relative rotation of the links 44 and 45 relative to the pivot axis C—C and B—B. Only upon activation of the tilt cylinder 52 to rotate the pivot shaft 38 is it possible to change the pitch of the bucket by changing the angular relationship of the connecting points between the first end of the links and the arms 40 and 41 relative to the pivot axis C—C. When the tilt cylinder is not activated, as the bucket is raised, the pivot points 42 and 49 and 43 and 50 of the links 44 and 45 retain their same orientation with respect to one another thereby ensuring the positive pitch alignment of the bucket relative to the tractor. Further, the links, during periods of the raising and lowering of the lift arms, will in some instances work together to anchor the bucket relative to the lift arms and will at other times act independently with respect to one another to anchor the bucket with respect to the lift arms. Further, the link members are always retained in parallel relationship even though the vertical spacing between them may be altered as the implement is raised or lowered beyond a given degree of rotation with respect to the axis C—C.

In effect, the tilt linkage mechanism 35 of the present invention defines an imaginary multiple parallelogram linkage which, in the preferred embodiments shown, is a double parallelogram system. With respect to the embodiments of FIGS. 1–10, the double parallelograms are defined along the links 44 and 45 from pivot axis C—C, along arms 40 and 41, along the lift arms from pivot axis C—C to B—B and along imaginary lines from pivot axis B—B to the pivots 49 and 50. The lines of the parallelogram do not actually follow the lift arms but rather extend between the pivot points at C—C and B—B.

With particular reference to FIG. 6, to change the pitch of the bucket regardless of the angle of inclination of the lift arms, appropriate controls, not shown, are activated to supply fluid to the cylinder 52 to extend or retract the piston rod 60. In FIG. 6, the extension rod has been extended thereby pivoting the pivot shaft 38. As the control lever is forced downwardly relative to the lift arms 18, the pivot shaft 38 is rotated clockwise thereby urging control link 44 forwardly toward the implement WB. This same action automatically shifts the control link 45 rearwardly from the implement and also changes the angular relationship of the arms 40 and 41. This action also shifts the stabilizing arms 53 which support the cylinder 52. The angle of the cylinder 52 is therefore increased to an angle $\alpha_1$ which is greater than the angle α of FIGS. 3–5. By retracting the piston rod 60, a reverse rotation of the implement would be obtained. It should be noted that the stabilizing levers 56 remain parallel to the lift arms 18 during the rotation of the bucket caused by the activation of the cylinder 52. The single parallel linkage created by the stabilizing levers 56 allows a fixed relationship to be maintained between the pivot axis C—C of the cylinder and the pivot axis A—A of the lift arms which is necessary in order to assure that there is no change in pitch angle to the implement when the cylinder is not activated and the lift arms are raised or lowered.

Figure 11:
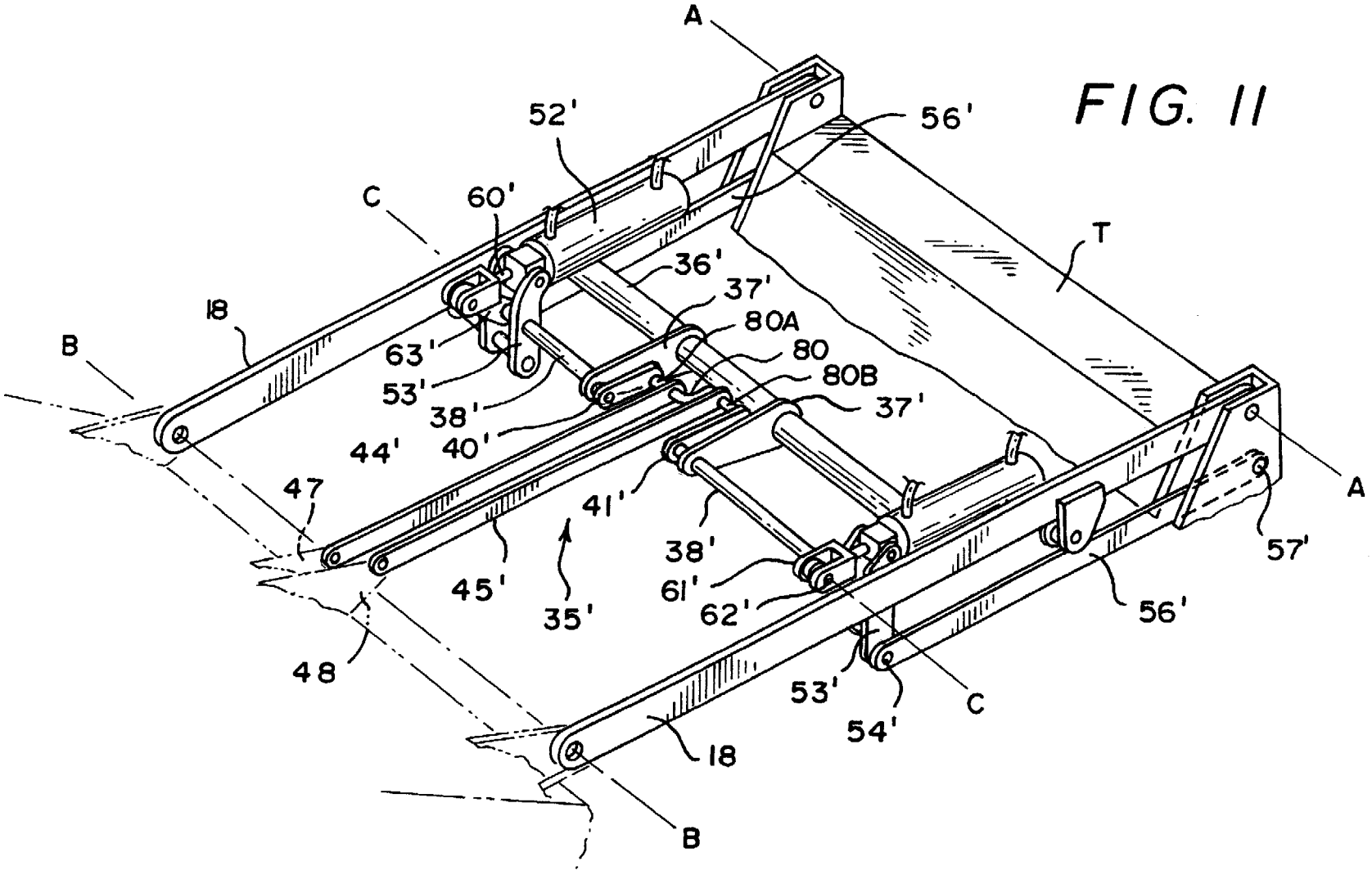
FIG. 11 is a front perspective view of an alternate embodiment of the present invention.

With particular reference to FIG. 11, another embodiment of the present invention is disclosed in greater detail. In this embodiment, a pair of bucket or implement pitch controls cylinders 52' are utilized for controlling the pivotal movement of the implement relative to the lift arms 18. Such a double cylinder arrangement may be necessary where extreme loads are to be encountered during the use of the implement. The operation of the tilt linkage assembly 35' of the present embodiment is substantially identical to that of the previous embodiments with the exception as to the manner in which the links 44' and 45' are connected to the piston rods 60' of each of the cylinders 52'.

A support rod 36' extends between and is secured in fixed relationship perpendicularly to the lift arms 18. Mounted to the support rod 36' are two mounting brackets 37' which are disposed between the cylinders 52'. The mounting brackets 37' are fixedly secured to the support rod 36' and extend generally parallel to the lift arms 18 and support a pair of spaced but aligned pivot shafts 38' which have their outer ends pivotally mounted to the lift arms 18. Fixedly mounted to the two pivot shafts 38' are a pair of spaced control levers 63' which are connected at pivot points 62' to brackets 61' connected to the outer end of the piston rods 60' associated with each cylinder 52'.

In the present embodiment, the arms 40 and 41 of the double parallelogram linkage have been modified. As shown, arm 40' is fixedly mounted to one of the pivot shafts 38' while the arm 41' is fixedly mounted to the other pivot shaft. Arm 40' is shorter than arm 41' and the arms are oriented parallel and generally coplanar with respect to one another. The outer ends of the arms are pivotally connected to opposite ends 80A and 80B of a double crank 80. Likewise, the inner ends of the links 44' and 45' are pivotally connected to the ends of the double crank 80. In this manner, when the pivot shafts 38' are rotated, both of the arms 40' and 41' of the double parallelogram linkage will be simultaneously moved by the double crank mechanism which also simultaneously moves the links 44' and 45'.

In order to stabilize each of the cylinders 52' with respect to the lift arms 18, a single parallel linkage mechanism similar to that discussed with respect to the previous embodiment is disclosed which incorporates a pair of spaced stabilizing levers 56' which are mounted at there first ends to pivot rods 55' which are pivotally connected to the lower end of a pair of spaced stabilizer arms 53' which are pivotally connected at 54' to one end of each of the hydraulic cylinders 52' in a manner as previously discussed. The second or opposite ends of each of the stabilizing levers 56' are pivotally connected at 57' to the brackets 12 and 13 of the lift arm towers of the vehicle so as to establish a pivot axis which is aligned below and generally parallel to the pivot axis A—A of the lift arms. As opposed to using a single stabilizing lever 56' for each cylinder 52', a pair of such stabilizing levers can be mounted on either side of each cylinder 52' as was discussed with respect to the embodiment in FIGS. 1–10. Each cylinder includes a piston rod 60' which is pivotally connected to a control lever 63' fixedly mounted to a pivot shaft 38'.

The operation of the linkage mechanism of the present embodiment is similar to that of the previous embodiment. The lift cylinders 52' will retain a fixed relationship with respect to an imaginary horizontal line regardless of the elevational angle of the lift arms 18 thereby maintaining a constant pitch angle for the implement during the raising and lowering of the implement lift arms. In order to change the pitch of the implement, it is necessary to simultaneously activate the cylinders 52' to extend or retract the piston rods 60' and thereby rotate the pivot shafts 38' to vary the relationship of the links 44' and 45'.

Figure 13:
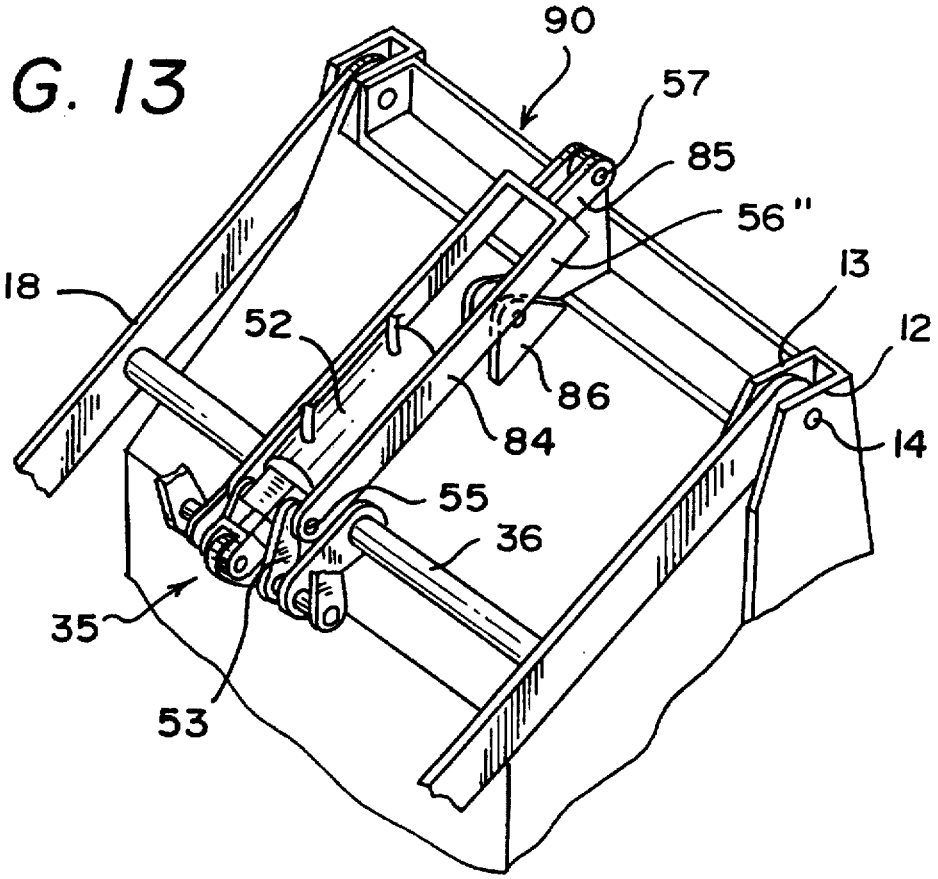
FIG. 13 is a partial top perspective view showing a variation of stabilizing lever utilized with the linkage assembly of the present invention.
Figure 12:
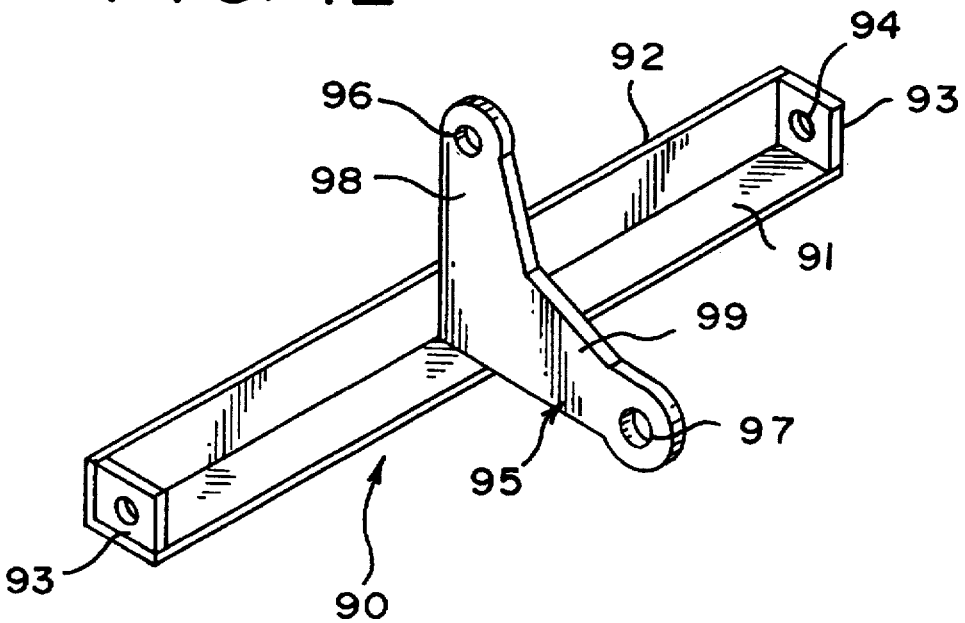
FIG. 12 is a perspective view of a mounting bracket which may be utilized to adapt the linkage system of the present invention to existing vehicles.

With particular reference to FIGS. 12 and 13, a bracket for mounting the single parallelogram linkage which is utilized to stabilize the hydraulic cylinder of the parallel linkages is disclosed in greater detail. This bracket is utilized so as to incorporate features of existing vehicles to retrofit such vehicles with the double parallelogram linkage bucket tilt control assembly of the present invention.

With specific reference to FIG. 13 on some conventional front end loading equipment, a hydraulic cylinder is mounted to a pair of spaced brackets which are secured to the front end of the vehicle with the cylinder being utilized to control the pitch of the implement. Utilizing the teachings of the present invention, such hydraulic cylinders directly mounted to the vehicle are removed and a special connecting bracket 90 such as shown in FIG. 11 is utilized to adapt the vehicle to utilize the double parallelogram linkage of the present invention.

As shown in FIG. 12, the adapter bracket includes an elongated channel member having a base flange 91 and a rear flange 92 which extends generally perpendicularly with respect to the base flange. A pair of end plates 93 are mounted to the flanges 91 and 92 and the end plates are provided with central apertures 94 for receiving pivot pins 14 which are utilized to pivotally connect the inner ends of the implement lift arms to the flanges 12 and 13 of the lift tower of the vehicle. A generally L-shaped plate 95 is fixedly welded intermediate the end plates 93 and openings 96 and 97 are provided in each of the extension portions 98 and 99 of the L-shaped plate. The opening 96 is positioned so as to be directly above the pivot axis A—A of the vehicle lift arms and is used for securing the outer ends of a modified piston stabilizing lever 56' which functions in the same manner as the stabilizing levers disclosed in the embodiments of FIGS. 1 and 11. In this embodiment, the stabilizing lever 56" includes a generally U-shaped yoke 84 having outer ends which are pivotally connected at 55 to the stabilizing arms 53 of the parallel linkage assembly 35 described in FIG. 1 and as identified generally at 35. The yoke is connected to a pair of extension elements 85 which are pivotally connected by pivot pin 57 to the upper extension of the plate 95. To provide further reinforcement for the mounting bracket 90, the extension 99 of the plate is connected between the existing spaced brackets 86 of the vehicle.

The use of the bracket 90 is shown in FIG. 13 wherein the single parallelogram linkage including the stabilizer lever assembly 56" is connected to stabilize a piston 52 associated with the parallelogram assembly 35 which is identical to that disclosed in FIG. 1. The elements of the invention are identified by the same numbers in FIG. 13 which were utilized in the description of the embodiment in FIG. 1 and the operation of the parallel tilt linkage system is the same.

As previously mentioned, with the linkage assembly 35, it is possible to form a plurality of end-to-end double parallelogram systems. In this manner, the displacement of the implement may be facilitated to allow operation in areas which would otherwise not be possible utilizing only one double parallelogram linkage system.

With particular reference to FIGS. 14 and 15, a further embodiment of the present invention is disclosed in greater detail. In this embodiment, the single parallel linkage and the multiple double parallel linkages are illustrated as they would be attached to the structure of a multi-element lift arm of a backhoe. The backhoe boom or lift arm is pivotally connected at 100 either directly to the implement or to a support structure extending from the implement which is pivotal about a shaft 100' thereby allowing rotation of the boom relative to the vehicle about a vertical axis. The boom includes a first portion 102 to which a second boom portion 103 is pivotally secured at 238. The outer boom portion 103 includes a depending section 104 to which a bucket WB is pivotally secured at 105. The pivot axis 105 determines a pivot axis similar to that of B—B of FIG. 1. Section 102 of the boom is controlled by a hydraulic cylinder 108 while pivotal movement of the outer boom section 103 is controlled by a cylinder 110 mounted to one or more brackets 111 secured to a portion of the boom section 102. The cylinder 110 includes a piston rod which is pivotally connected at 112 to a bracket assembly 113 mounted to the lower end portion of the outer boom section 103.

In the present embodiment, the pivot axis defined at 109 creates a secondary axis B—B for determination of the plural double parallelogram linkages. For purposes of assisting in the understanding of the linkage of the present embodiment, the same numbers utilized in the embodiment of FIGS. 1–10 will be utilized with a prefix of 100 being added thereto for the first double parallelogram linkage and a prefix of 200 for the second double parallelogram linkage and 300 for the third double parallelogram linkage. It should be noted that only a single cylinder 152 is necessary to control the operation of the multiple double parallelogram linkage assembly of this embodiment of the invention. As with the previous embodiments, the angle of the cylinder will not change during the vertical displacement of the boom sections 102 and 103 unless a change in the pitch position of the bucket WB is desired by activating the piston rod 160 associated therewith.

Cylinder 152 is stabilized by stabilizing arms 153 which are pivotally connected to stabilizing levers 156 which are pivotally mounted at 157 to a fixed link 158 which is pivotally connected to the pivot pin 100 and a pin 101 which connects cylinder 108 to the vehicle. In this embodiment, the pivot point 154 between the stabilizing lever 156 and the stabilizing arm 153 is equally spaced with respect to the pivot shaft 138 as the pivot point 157 is with respect to the pivot point 100. The first double parallelogram linkage includes a pair of links 144 and 145 which are fixedly connected to the pivot shaft 138 by arms 140 and 141, respectively. Rotation of the pivot shaft 138 is controlled by the piston rod 160 being extended or retracted and which is connected through control lever 163 to the shaft 138 in a manner which will be described below. Each of the arms 144 and 145 are disposed parallel and are maneuverable in the same manner as discussed with the previous embodiments.

Each of the links 144 and 145 are pivotally connected at 121 and 122 to second parallelogram arms 240 and 241. Second double parallelogram links 244 and 245 extend therefrom to a third set of pivot points shown at 123 and 124. The arms 240 and 241 pivot about the pivot shaft 238 and pivot arms 340 and 341 pivot about a pivot shaft 348. The spacing between each of the pivot points connecting the links 144 and 145 with the pivot shaft 138, the arms 240 and 241 with pivot point 238, and the pivot points for 340 and 341 with respect to pivot shaft 348 are equal with respect to one another. The length of the arms 144 and 145 and 244 and 245 as well as 344 and 345 may be varied. From the pivot points 123 and 124, the final links 344 and 345 are connected to brackets 48 and 47 respectively at pivot points 50 and 49 in the same manner as disclosed in the embodiment of FIGS. 1–10. The bucket pivot 105 extends between brackets 47 and 48.

Again, unless the cylinder 152 is activated to extend or retract the piston rod 160, the inclination of the bucket WB will remain constant regardless of the elevational positioning of the sections of the implement support arm 102 and 103 by activation of the cylinders 108 and 110.

In the present embodiment, the tilt linkage control cylinder 152 must be able to pivot through at least 180 degrees. Therefore, it is necessary to ensure that the piston rod 160 does not interfere or contact the pivot shaft 138. In order to accomplish this, a pair of supplemental levers 380 and 382 are provided for positioning the end of the piston rod relative to the pivot shaft 138. Lever 380 is pivotally connected at 383 intermediate the length of the stabilizing arm 153 as shown in FIG. 15. Whereas, lever 382 is pivotally connected at its outer end at 384 to the end of the control lever 163. As the cylinder rod is actuated, the control lever 163 will pivot about shaft 138 to thereby control the movement of the arms 140 and 141 and the first double parallel linkage including links 144 and 145. At the same time, the levers 380 and 382 will space the end of the piston rod from the pivot shaft 138, thereby allowing a complete 180 degree movement of the tilt linkage cylinder 152 relative to the pivot shaft. It should be noted that stabilizing arms 153 are rigid between the pivot shaft 138 and the pivot axis 154 and that the lever 380 is pivotal at 383 along the length of the stabilizing arms.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

I claim:

1. A tilt linkage assembly for self-leveling of an implement relative to a vehicle having at least one lift arm having a first end pivotally mounted to the vehicle about a first pivot axis and a second end pivotally mounted relative to the implement about a second pivot axis and wherein the first and second pivot axes are generally parallel with respect to one another, the tilt linkage assembly comprising: at least one pivot shaft oriented along a third pivot axis intermediate said first and second pivot axes and extending parallel thereto, support means for pivotally supporting said at least one pivot shaft to the at least one lift arm intermediate the first and second ends of the at least one lift arm, at least one parallel linkage assembly extending between and connecting said at least one pivot shaft to the implement, said at least one parallel linkage assembly including first and second arms fixedly mounted to said at least one pivot shaft and first and second parallel links having first and second ends, said at least one parallel linkage assembly also including first and second pivot means for pivotally connecting said first ends of said first and second links to said first and second arms, respectively, third and fourth pivot means for pivotally connecting said second ends of said first and second links to the implement with said third and fourth pivot means being spaced on opposite sides of said second pivot axis, an actuation means having an extension rod and wherein said actuation means extends said extension rod, means for connecting said extension rod to said at least one pivot shaft, stabilizer arm means for supporting said actuation means and being pivotally connected to said at least one pivot shaft and having an end pivotally connected to said actuation means, stabilizer lever means for connecting said stabilizer arm means to the vehicle and having a first end pivotally connected to said stabilizer arm means and a second end for pivotally connecting said second end of said stabilizer lever means to the vehicle about an axis parallel to said first pivot axis, said actuation means being retained in a fixed angular relationship relative to the implement to thereby retain said implement at a fixed pitch unless said extension rod is moved to rotate said at least one pivot shaft and thereby shift said at least one parallel linkage to pivot the implement about the second pivot axis.

2. The tilt linkage assembly of claim 1 wherein said first and second pivot means are equally spaced from said at least one pivot shaft.

3. The tilt linkage assembly of claim 2 wherein said first and second pivot means are spaced at a distance from said at least one pivot shaft equal to a distance at which each of said third and fourth pivot means are spaced from said second pivot axis.

4. The tilt linkage assembly of claim 1, including a plurality of spaced pivot shafts pivotally mounted to said at least one lift arm intermediate the first and second ends thereof and a plurality of parallel linkage assemblies connected to said plurality of spaced pivot shafts, said second ends of said first and second links of said at least one parallel linkage assembly being pivotally connected to said first and second pivot means of an adjacent parallel linkage assembly.

5. The tilt linkage assembly of claim 4 in which each of said first and second arms of each of said parallel linkage assemblies are fixedly mounted in the same angular relationship with respect to one another to said plurality of pivot shafts.

6. The tilt linkage assembly of claim 5 wherein said third and fourth pivot means include a pair of spaced brackets mounted to the implement, and pivot pins for connecting said second ends of said first and second links of one of said parallel linkage assemblies to said spaced brackets.

7. The tilt linkage assembly of claim 5 wherein said first and second pivot means are equally spaced from said at least one pivot shaft.

8. The tilt linkage assembly of claim 1 in which each of said first and second arms are fixedly mounted in angular relationship with respect to one another to said at least one pivot shaft.

9. The tilt linkage assembly of claim 8 in which said means for pivotally connecting said second end of said stabilizer lever means to the vehicle includes a bracket having end portions adapted to be aligned with the first pivot axis, a plate mounted to said bracket and having at least one upstanding extension having an opening therein having a central axis of which is spaced from but parallel to said first pivot axis.

10. The tilt linkage assembly of claim 9 in which said plate of said bracket further includes a forward extension having an opening therein, and means for securing said forward extension to the vehicle.

11. The tilt linkage assembly of claim 1 wherein said third and fourth pivot means include a pair of spaced brackets mounted to the implement, and pivot pins for connecting said second ends of said first and second links to said spaced brackets.

12. A tilt linkage assembly for self-leveling of an implement relative to a vehicle having a pair of generally parallel lift arms having first ends pivotally mounted to the vehicle about a first pivot axis and second ends pivotally mounted relative to the implement about a second pivot axis and wherein the first and second pivot axes are generally parallel with respect to one another, the tilt linkage assembly comprising: at least one pivot shaft oriented along a third pivot axis intermediate said first and second pivot axes and extending parallel thereto, support means for pivotally supporting said at least one pivot shaft to the lift arms intermediate the first and second ends of the lift arms, at least one parallel linkage assembly extending between and connecting said at least one pivot shaft to the implement, said at least one parallel linkage assembly including first and second arms fixedly mounted to said at least one pivot shaft and first and second parallel links having first and second ends, said at least one parallel linkage assembly also including first and second pivot means for pivotally connecting said first ends of said first and second links to said first and second arms, respectively, third and fourth pivot means for pivotally connecting said second ends of said first and second links to the implement with said third and fourth pivot means being spaced on opposite sides of said second pivot axis, an actuation means having an extension rod and wherein said actuation means extends said extension rod, means for connecting said extension rod to said at least one pivot shaft, stabilizer arm means for supporting said actuation means and being pivotally connected to said at least one pivot shaft and pivotally connected to said actuation means, stabilizer lever means for connecting said stabilizer arm means to the vehicle and having a first end pivotally connected to said stabilizer arm means and a second end for pivotally connecting said second end of said stabilizer lever means to the vehicle about an axis parallel to said first pivot axis, said actuation means being retained in a fixed angularly relationship relative to the implement to thereby retain said implement at a fixed pitch unless said extension rod is moved to rotate said at least one pivot shaft and thereby shift said at least one parallel linkage to pivot the implement about the second pivot axis.

13. The tilt linkage assembly of claim 12 including a second pivot shaft aligned with the first pivot shaft and spaced therefrom, a second actuation means for extending a second extension rod, a second stabilizer arm means pivotally mounted to said second pivot shaft.

14. The tilt linkage assembly of claim 13 wherein said first arm is fixedly mounted to one of said pivot shafts and said second arm is fixedly mounted to the other of said pivot shafts, and said first and second pivot means includes a double ended crank connecting said first ends of said first and second links to each of said first and second arms.

15. The tilt linkage assembly of claim 14 wherein said first and second arms are generally oriented parallel with respect to one another, said first arm being of a length between said one of said pivot shafts and said double ended crank which is different than the length of said second arm between the other of said pivot shafts and said double ended crank.

* * * * *